US005966498A

United States Patent [19]

Kirchner et al.

[11] Patent Number: 5,966,498

[45] Date of Patent: Oct. 12, 1999

[54] END CLOSURE ASSEMBLY FOR OIL-FILLED HEATER

[75] Inventors: Stephen C. Kirchner, Palatine; Andrei Illies, Chicago, both of Ill.

[73] Assignee: Lakewood Engineering and Manufacturing Company, Chicago, Ill.

[21] Appl. No.: 08/693,451

[22] Filed: Aug. 7, 1996

[51] Int. Cl.[6] ..... F24D 13/04

[52] U.S. Cl. ..... 392/357; 392/377; 219/540

[58] Field of Search ..... 392/357, 377, 392/378, 497–501; 165/128–131, 148, 151, 152, DIG. 501; 237/16, 70; 219/530, 540

[56] References Cited

U.S. PATENT DOCUMENTS

| | | | |
|---|---|---|---|
| D. 314,613 | 2/1991 | De'Longhi . | |
| 777,289 | 12/1904 | Kinnear | 165/130 |
| 1,224,677 | 5/1917 | Singer | 165/130 |
| 1,230,812 | 6/1917 | Singer | 165/130 |
| 1,561,038 | 11/1925 | Wade | 392/497 |
| 1,763,328 | 6/1930 | Robinson | 392/378 |
| 1,853,487 | 4/1932 | Young | 165/130 |
| 2,448,669 | 9/1948 | Green, Jr. | 392/497 |
| 2,457,596 | 12/1948 | Osterheld | 392/497 |
| 2,457,597 | 12/1948 | Osterheld | 392/501 |
| 2,533,615 | 12/1950 | Osterheld | 392/501 |
| 2,567,515 | 9/1951 | Janik | 165/130 |
| 2,877,630 | 3/1959 | Schultz | 392/497 |
| 3,202,796 | 8/1965 | Drugmand | 392/497 |
| 4,253,009 | 2/1981 | Jordan | 392/501 |
| 4,870,253 | 9/1989 | De'Longhi . | |
| 4,873,421 | 10/1989 | Brehmer et al. | 392/378 |
| 5,471,026 | 11/1995 | Ilies . | |

FOREIGN PATENT DOCUMENTS

| | | | |
|---|---|---|---|
| 45831 | 7/1910 | Austria | 165/130 |
| 1244821 | 11/1988 | Canada . | |
| 53975 | 12/1937 | Denmark | 165/130 |
| 70847 | 3/1929 | Sweden | 165/130 |
| 46681 | 2/1909 | Switzerland | 165/130 |
| 371605 | 4/1932 | United Kingdom | 165/130 |
| 673071 | 6/1952 | United Kingdom | 165/130 |

*Primary Examiner*—Philip H. Leung
*Assistant Examiner*—Shawntina Fuqua
*Attorney, Agent, or Firm*—Wallenstein & Wagner, Ltd.

[57] ABSTRACT

An oil-filled heater (22) comprises a plate (34) welded onto the top opening in a fin of the heater. The plate (34) has a threaded opening (36), and a bolt (38) is threaded into the threaded opening (36) to seal the top opening. The bottom opening of the fin is sealed by a heating element (42) welded onto the fin. The present invention further relates to a method of filling the oil-filled heater (22).

6 Claims, 2 Drawing Sheets

END CLOSURE ASSEMBLY FOR OIL-FILLED HEATER

TECHNICAL FIELD

The present invention relates generally to a liquid-filled portable heater assembly. More specifically, this invention relates to an improved end closure assembly for oil-filled heaters and a method of filling and sealing the oil-filled heater.

BACKGROUND OF THE INVENTION

Conventional liquid-filled electric radiant heaters, such as electric oil-filled heaters, provide a portable means for producing heat. Generally, in an oil-filled heater, oil flows through a set of radiating elements or fins, and is heated when it comes into contact with a heating element.

Oil-filled heaters are formed from a plurality of metal, rectangular-shaped chambers, known as fins. Each fin is provided with a cavity to accommodate or contain the oil. With the exception of the rear end fin, each fin has two openings on each side of the fin which align with corresponding openings in adjacent fins. The rear end fin has one side with no openings, as this side of the fin is typically exposed (i.e., is not covered by a shroud). The fins are welded together around the openings, providing a path within the heater through which the oil may flow. After the fins are welded together, the openings of the front end fin remains unsealed. These openings of the front end fin provide for insertion and attachment of the heating element and the filling of the oil medium. The heater may be painted after the outer fins are sealed onto the fin assembly and after one of the front end openings is sealed. However, the heater must be filled with oil after the heater is subjected to the heat of conventional industry painting operations.

The prior art heater assemblies, as shown in FIGS. 5 and 6, include a closure for the openings of the front end fin. The bottom opening of the front end fin is sealed using a bottom end closure assembly, as shown in FIG. 6. The bottom end closure assembly includes a threaded inner nut 10, a threaded heating element 18 and a gasket 16.

The threaded inner nut 10 is inserted into the fin adjacent the bottom opening. The inner nut 10 must be inserted into the fin prior to sealing the fin halves together. The inner nuts 10 have legs 12 extending from the sides of the threaded portion 14 to place the threaded portion 14 in the proximity of the opening. Thus, once the inner nuts 10 are inserted into the fin and the fin is assembled, that fin must be oriented so that the threaded portion 14 faces the front end of the heater assembly.

The threaded heating element 18 is inserted into the front bottom opening and manually threaded onto the threaded inner nut 10. The gasket 16 is placed between the heating element 18 and the side of the fin to restrict oil leakage from within the heater. A wrench is used to apply rotational force of the heating element 18 to compress the gasket 16; thus, the heating element 18 typically has a hexagonal-shaped head.

The front top opening of prior art heaters is sealed using a top end closure assembly, as shown in FIG. 5. The top end closure assembly consists of a plate 20 which is welded onto the front top opening. In the alternative, a more common top end closure assembly resembles the bottom closure described above, as it includes a threaded inner plug, a threaded cover plate and a gasket. In the alternative embodiment, the threaded inner plug is inserted within the fin prior to assembly of the fin. The inner plug is placed adjacent the front top opening in a manner similar to that for the bottom end closure assembly described above. The threaded cover plate is then manually threaded into the top inner plug, with a gasket placed between the cover plate and the top inner plug to compress and thereby restrict oil leakage between the bolt and the top inner plug. The cover plate, like the heating element 18, generally has a hexagonal-shaped head for the same reasons stated above.

Generally, prior art heaters are filled by first sealing the top opening, as described above. Oil is then filled into the heater through the bottom opening, the heating element is inserted, and the bottom opening is sealed by compression of the gasket between the heater body and the heating element, as described above. In the alternative, the bottom opening may be sealed prior to filling the heater through the top opening, and the top opening may then be sealed by using a threaded cover plate.

One problem which arises with conventional oil-filled heaters is that the heaters tend to leak around the gaskets. This leakage is believed to be primarily caused by repeated heating and cooling of the gasket due to normal use of the heater. Also, the seal formed by the compression of the gasket may leak due to poor alignment of the heating element when threaded into the insert, or due to misalignment. The oil leak is unsightly, and creates a mess around the heater. In addition, leakage of oil results in loss of volume of oil within the heater and leads to a decrease or loss of oil circulation. If an insufficient amount of oil is circulating in the heater, the heater is inefficient, as the top of the fins are cold and the bottom of the fins overheat, resulting in discoloration of the fins.

Another problem prevalent in conventional oil-filled heaters is that the method of sealing the heaters is quite involved and complex and is inherently unreliable. Because the outer fin requires threaded inner plugs to be inserted prior to welding the fin halves together, the time and cost of manufacturing that end fin is higher. Further, because of the inserted threaded plug, the end fin is not interchangeable and all of the fins cannot be assembled using the same steps, as in an assembly line. Rather, the outer fins must be assembled using a different procedure so that the inner plugs are inserted prior to welding the fin halves together. Further, these end fins must be in the proper orientation when assembled to the other fins of the heater to ensure that the threaded portion can receive the bolt or heating element. Yet another problem with prior art heater assemblies is that the gasket seal is susceptible to leakage, and the threading is difficult to align.

Because the inner plugs are not secured to the fins, to ensure proper placement of the inner plug, the heating element and/or threaded plate must be manually threaded onto the heating assembly.

SUMMARY OF THE INVENTION

The present invention relates generally to a liquid-filled portable electric heater assembly, typically filled with oil. More specifically, this invention relates to an improved end closure assembly for oil-filled heaters and a method of filling and sealing the oil-filled heater. The improved end closure assembly prevents the heater from leaking oil, as found in conventional oil-filled heaters. Further, the improved end closure assembly provides an easier and less expensive manufacturing procedure.

According to a first aspect of the present invention, a plate with a threaded opening is welded onto the top opening, and a heating element is welded onto the bottom opening of the front outer fin. Because the plate and heating element are welded onto the fin, there is no need for inner plugs, no need for a gasket ring, and there is no internal threading in the present invention.

Because there is no need for inner plugs, the front end fin is manufactured identically to the other fins, and there is no need for inserting a threaded plug prior to sealing the fin halves together. In addition, there will be no misalignment of the inner plugs so that the threaded plate or threaded heating element do not need to be manually threaded onto the plate. As a result, both the cost of manufacturing the heaters and the complexity of assembling the heaters is reduced.

The present invention does not require the use of any gaskets, which are the cause of most leakages in oil-filled heaters. The design of the present invention provides for a threaded seal, whereas the prior art designs merely provided a gasket-seal, which is tightened by threaded parts. The threaded seal is coated with a threading compound to facilitate the seal between the threads. The threading compound seals is more efficient at preventing leakages than the gaskets because the threading compound seals along the threading rather than merely sealing by a pressure-fit gasket. With no leakage, all of the oil-filled heaters of the present invention can safely and continuously run at their full heating capacity.

Paint may be baked onto the heater after the plate and heating element are welded onto the fin assembly, prior to filling the heater with oil. Oil is filled into the threaded opening of the top plate, and a threaded plug is threaded into the opening, thus sealing the entire heating assembly.

Other features and advantages of the invention will be apparent from the following specification taken in conjunction with the drawings.

DETAILED DESCRIPTION OF THE PREFERRED EMBODIMENT

Although the present invention can be made in many different forms, the preferred embodiment is described in this disclosure and shown in the attached drawings. This disclosure exemplifies the principles of the present invention and does not limit the broad aspects of the invention only to the illustrated embodiment.

Figure 2:
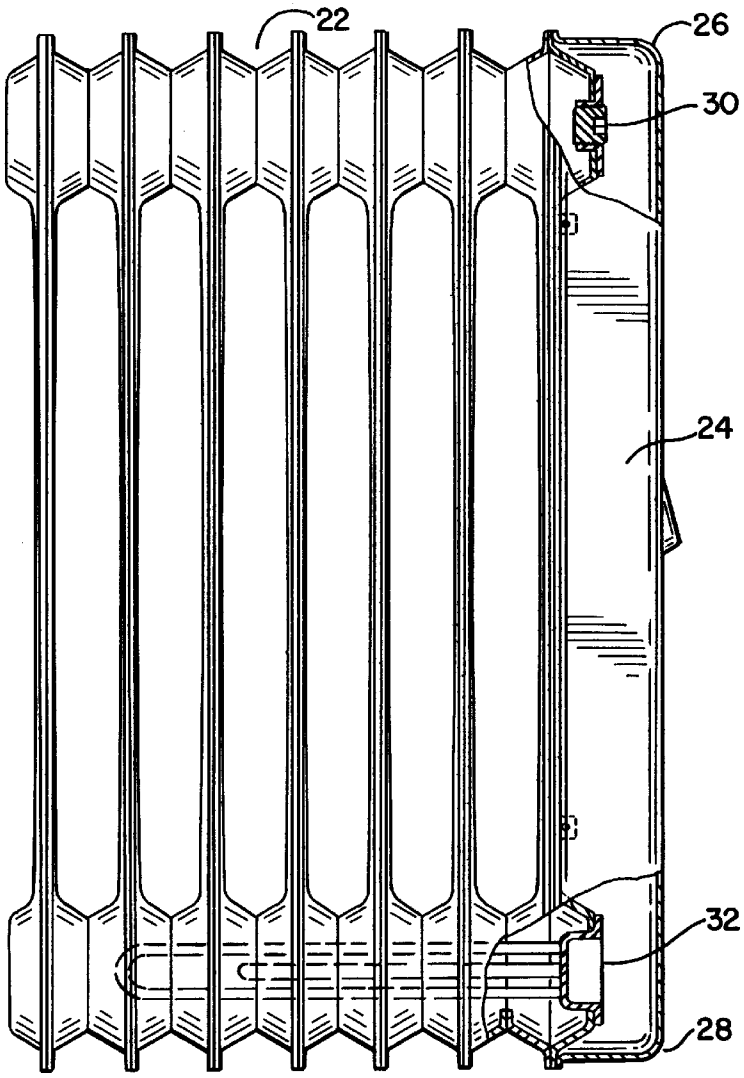
FIG. 2 is a side view of an oil-filled heater of the present invention, with a portion of the front end panel removed and the heating element shown.
Figure 1:
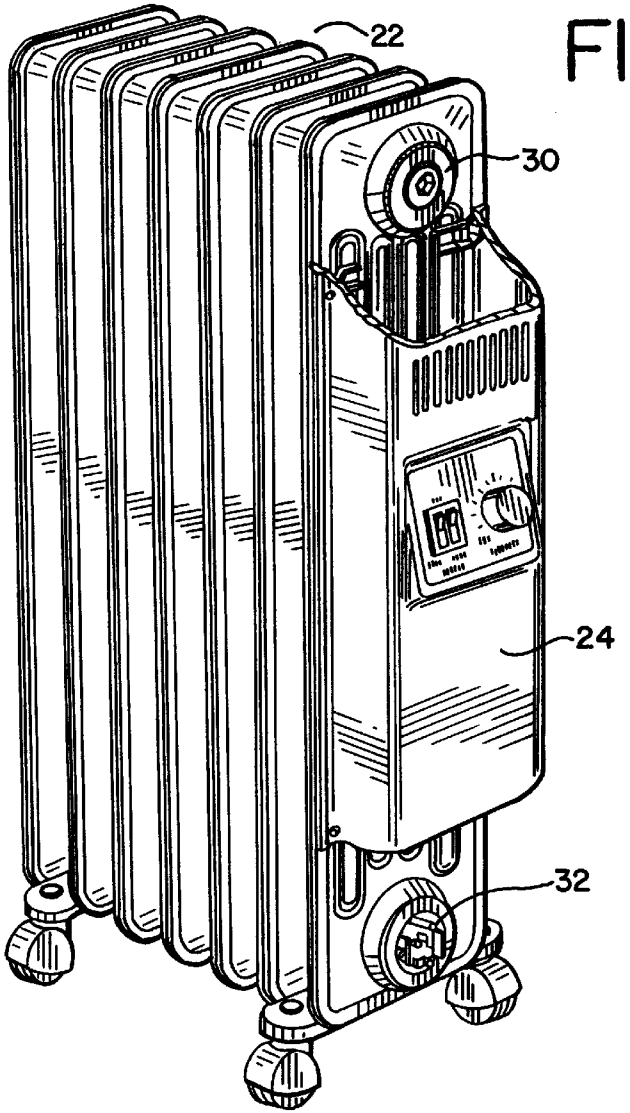
FIG. 1 is a perspective view of an oil-filled heater in accordance with the present invention, with portions of the front end panel removed.

FIGS. 1 and 2 show a perspective view and a side view, respectively, of an oil-filled heater 22 in accordance with the present invention. As shown in these figures, an end panel 24 covers the front end of the heater 22. Both the top 26 and bottom 28 portions of the end panel 24 are cut away from these figures to reveal a top end closure assembly 30 and a bottom end closure assembly 32.

Figure 3:
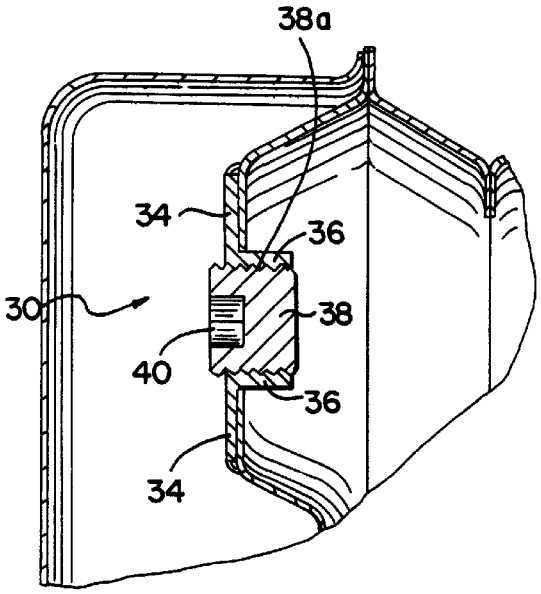
FIG. 3 is an exploded side view of the top end closure assembly of FIG. 2.
Figure 5:
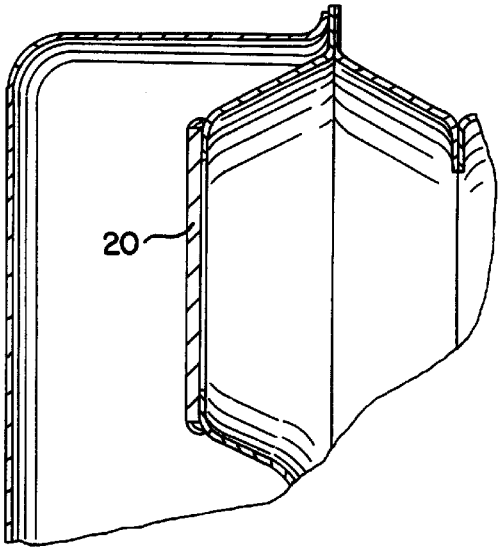
FIG.5 PRIOR ART
FIG. 5 is a prior art exploded side view of a top end closure assembly; and, FIG. 6 is a prior art exploded side view of a bottom end closure assembly.

FIG. 3 shows an exploded side view of the top end closure assembly 30 in accordance with the present invention. A plate 34 with a threaded opening 36 is welded onto the opening of the fin using a bead-weld. The threaded opening 36 of the top end closure assembly 30 is sealed using a threaded plug 38, preferably coated with a thread compound 38*a*. The head of the plug 38 is shown having a hexagonal depression 40 to receive a hex-driver. However, it is to be understood that the plug 38 is not limited to a hexagonal-shaped depression 40, and that any type of plug 38 or similar bolt may be used to seal the threaded opening 36. The threading of the plug 38 preferably is a tapered thread, such as with conventional dry-seal taper pipe threading.

Figure 4:
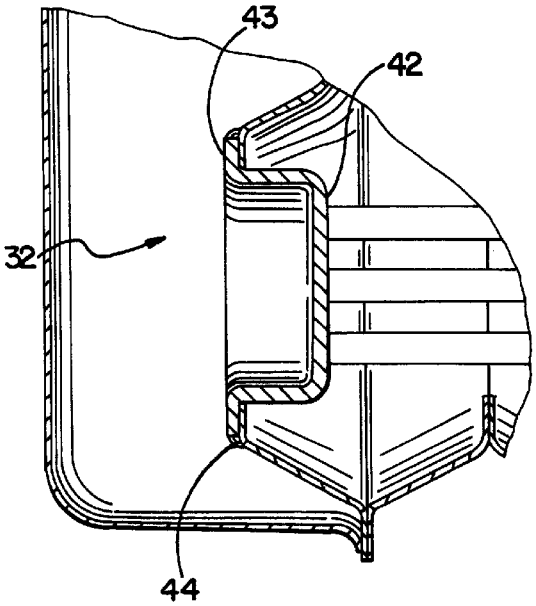
FIG. 4 is an exploded side view of the bottom end closure assembly of FIG. 2.
Figure 6:
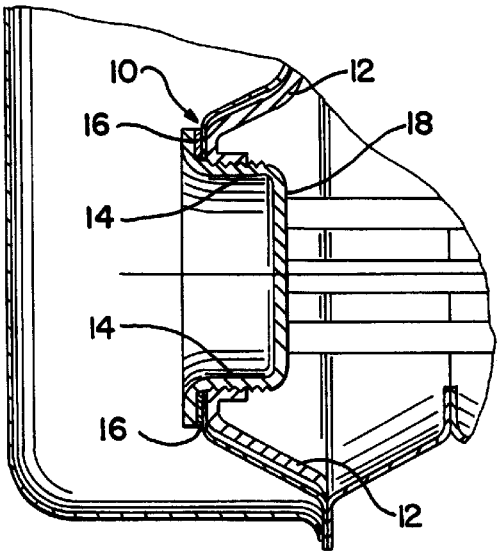
FIG.6 PRIOR ART

FIG. 4 shows an exploded side view of the bottom end closure assembly 32 in accordance with the present invention. A heating element 42 is inserted into the opening, and a flange 43 of the heating element is welded onto the fin with a bead-weld 44.

A method of filling and sealing the oil-filled heater in accordance with the principles of the present invention will now be described. First, using a bead-weld, the plate 34 with the threaded opening 36 is welded onto the top opening of the front outer fin, and the heating element 42 is inserted into the heater and is welded onto the bottom opening of the fin. The threaded opening 36 and the external components of heating element 42 are covered while paint is applied. The paint is then cured by heating the heating assembly, preferably heating at 350°–400° F. for a duration of approximately 30 minutes. After the painting and baking procedure, oil is filled into the heating assembly through the threaded opening 36 of the plate 34. A thread compound 38*a* is coated onto the threading of the plug 38 before the plug 38 is threaded into the threaded opening 36. Preferably, the threading compound 38*a* is made of an aramid fiber compound, coated as a film on the threads of the plug 38. Further, the plug 38 preferably has tapered threading, such that the plug 38 fits snug within the threaded opening of the plate 34, and provides a liquid-tight seal.

While the preferred embodiment has been illustrated and described, numerous changes and modifications can be made without significantly departing from the spirit and scope of this invention. Therefore, the inventor(s) intend that such changes and modifications be covered by the appended claims.

What I claim is:

1. In an electric oil-filled heater having a top end closure assembly to seal a top opening in a fin of the heater, wherein the top end closure assembly comprises:

a plate having a threaded opening, wherein the plate is welded onto the fin;

a bolt threaded into the threaded opening; and, further comprising a heating element having a flange directly welded to a bottom opening in the fin of the heater.

2. An electric oil-filled heater as claimed in claim 1, wherein the heating element is welded onto an outer surface of the fin using a beaded weld around on said flange of said element.

3. An electric oil-filled heater comprising;

a plurality of fins welded together;

a plate having a threaded opening, wherein the plate is welded onto a top opening in one of the plurality of fins;

a bolt threaded into the threaded opening to seal the top opening; and a heating element having a flange directly welded to a bottom opening in the one of the plurality of fins to seal the bottom opening.

4. An electric oil-filled heater as claimed in claim 3, wherein the bolt comprises;

a threading; and a compound coated on the threading.

5. An electric oil-filled heater as claimed in claim 3, wherein the plate is welded onto the fin using a beaded weld around.

6. An electric oil-filled heater as claimed in claim 3, wherein the heating element is welded onto an outer surface of the fin using a beaded weld around on the flange of the element.

* * * * *